US011940177B2

(12) United States Patent
Nixdorf

(10) Patent No.: US 11,940,177 B2
(45) Date of Patent: Mar. 26, 2024

(54) DIRECTLY HEATED DESICCANT WHEEL

(71) Applicant: MakeSHIFT Innovations, LLC, Asheville, NC (US)

(72) Inventor: William R. Nixdorf, Asheville, NC (US)

(73) Assignee: MakeSHIFT Innovations, LLC, Asheville, NC (US)

( * ) Notice: Subject to any disclaimer, the term of this patent is extended or adjusted under 35 U.S.C. 154(b) by 0 days.

(21) Appl. No.: 17/824,990

(22) Filed: May 26, 2022

(65) Prior Publication Data

US 2022/0381452 A1 Dec. 1, 2022

Related U.S. Application Data

(60) Provisional application No. 63/195,528, filed on Jun. 1, 2021.

(51) Int. Cl.
*F24F 3/14* (2006.01)
*B01D 53/26* (2006.01)

(52) U.S. Cl.
CPC .... *F24F 3/1423* (2013.01); *F24F 2203/1004* (2013.01); *F24F 2203/1036* (2013.01); *F24F 2203/106* (2013.01); *F24F 2203/1084* (2013.01)

(58) Field of Classification Search
CPC ..... F24F 3/1423; F24F 2203/1004; F24F 2203/1036; F24F 2203/106; F24F 2203/1084; F24F 2203/1032; B01D 53/26
See application file for complete search history.

(56) References Cited

U.S. PATENT DOCUMENTS 2,959,018 A * 11/1960 Hwang ..... F24F 5/0042 62/262
3,619,987 A * 11/1971 Hwang ..... F24F 3/1423 96/111
5,580,370 A * 12/1996 Kuma ..... F24F 3/1423 428/116
7,050,707 B1 * 5/2006 Lin ..... F24F 3/1423 392/347
2009/0229461 A1 * 9/2009 Jeng ..... F24F 3/1423 62/271
2010/0175557 A1 * 7/2010 Shih ..... B01D 53/261 96/146
2011/0088867 A1 * 4/2011 Steele ..... H02K 41/03 310/67 R
2017/0016646 A1 * 1/2017 Lee ..... F24F 11/46

* cited by examiner

*Primary Examiner* — David J Teitelbaum
*Assistant Examiner* — Jason N Thompson
(74) *Attorney, Agent, or Firm* — The Van Winkle Law Firm; William G. Heedy

(57) ABSTRACT

An air treatment apparatus (10), such as a dehumidifier or latent cooling system, has a desiccant wheel (12) having a plurality of similar internal structures (14), a shroud (16), at least a first fan (18, 20), a motor (30), an axle (32), slip rings (34), and sliding contacts (36). The similar internal structures are coated with a desiccant, and may be shaped as blades, cylinders, boxes, teeth, or corrugations. The shroud divides the wheel into an active area where the desiccant removes moisture to provide treated air (22), and a regeneration area where the desiccant is heated to release the adsorbed moisture from the air (28). Switches, such as magnetic switches, apply electrical power to heaters in the similar internal structures as they rotate into the regeneration area thereby heating and drying the desiccant.

20 Claims, 5 Drawing Sheets

DIRECTLY HEATED DESICCANT WHEEL

CROSS REFERENCE TO RELATED APPLICATIONS

The present application claims the priority of U.S. Provisional Patent Application Ser. No. 63/195,528 filed Jun. 1, 2021, entitled "DIRECTLY HEATED DESICCANT WHEEL", and which is incorporated herein in its entirety.

SUMMARY

A desiccant wheel (hereinafter "wheel") is directly heated, thereby improving efficiency and improving regeneration of the desiccant for subsequent use.

In an implementation, a desiccant configuration, such as a desiccant wheel, has a plurality of similar internal structures, a desiccant coating at least a portion of an internal structure, a plurality of electrical heaters, an electrical heater being interposed between an internal structure and a corresponding desiccant coating for the structure, and a plurality of switches, a switch of the plurality of switches selectively applying operating power to at least one electrical heater.

In an implementation, an air treatment apparatus has a desiccant wheel, a plurality of activators controlling a plurality of switches in the desiccant wheel, a motor to rotate the desiccant wheel, a shroud which separates the desiccant wheel into an active area and a regeneration area, and at least one fan which drives air through the desiccant wheel. An activator causes a switch to apply operating power to an electrical heater for a structure which is in the regeneration area.

DETAILED DESCRIPTION

Figure 1:
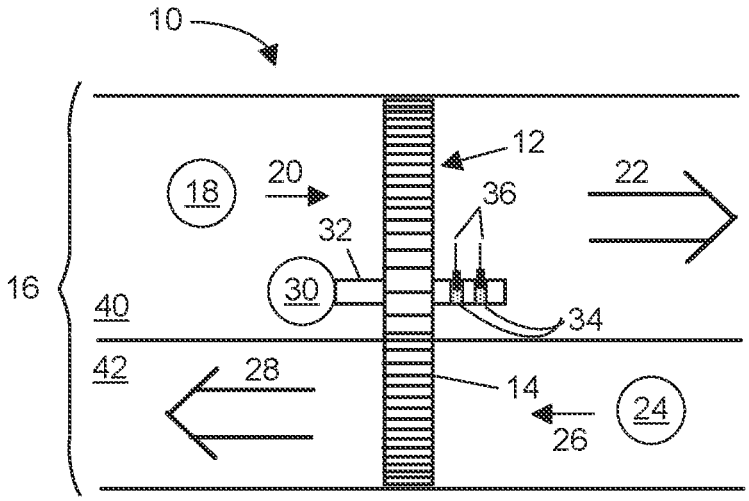
FIG. 1 is an illustration of a desiccant dehumidifier system.

FIG. 1 is an illustration of a desiccant dehumidifier system 10, which may also be used as a latent cooling system, showing a side view of an embodiment of a wheel 12 having a plurality of blades 14, a shroud 16, a fan 18 passing air in a first direction 20 to provide treated (dehumidified) air 22, and a fan 24 passing air in a second direction 26 to carry moisture-laden air 28 away from the wheel 12. Also shown are a motor 30 which drives (rotates) the wheel 12, a pair of slip rings 34 on an axle 32, and a pair of sliding contacts 36 for use with the slip rings 34. The motor 30 may drive the wheel 12 via the axle 32, a belt that wraps around the circumference of the wheel 12, a chain that wraps around the circumference of the wheel 12, gear teeth on periphery of the wheel 12, or other convenient and desirable means. Shroud 16 separates the wheel 12 into an active phase 40 and a regeneration phase 42.

The first and second fans may be driven by different motors or, if desired, may be driven by the same motor.

Figure 2:
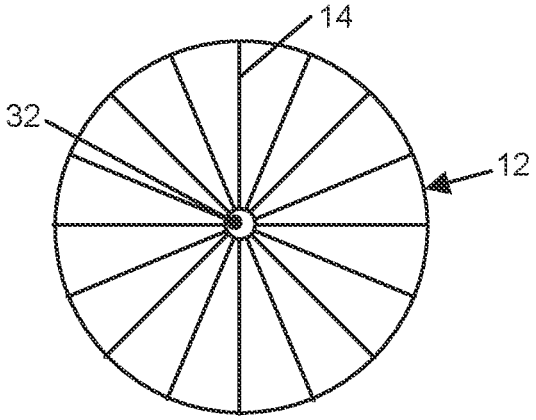
FIG. 2 is an illustration of a face view of an embodiment of an exemplary wheel.

FIG. 2 is an illustration of a face view of an embodiment of an exemplary wheel 12 showing the blades 14. The number of blades 14 shown is for clarity of illustration and a wheel 12 will preferably have a larger number of blades 14. In an embodiment, a wheel 12 has 64 blades 14.

Figure 3:
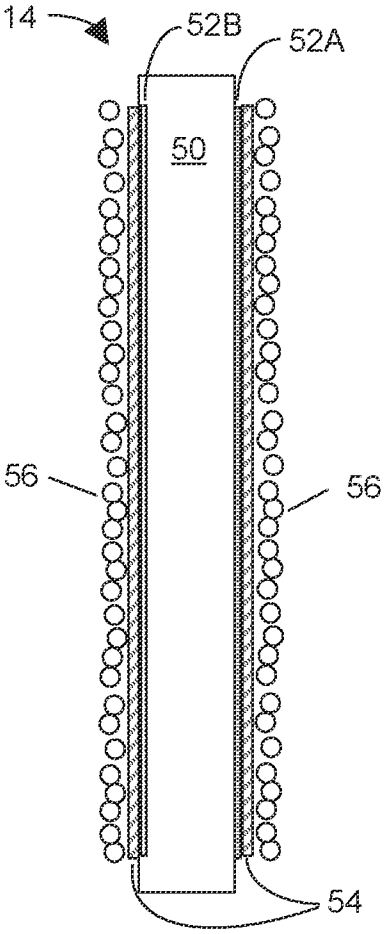
FIG. 3 is an illustration of a side view of an exemplary blade.

FIG. 3 is an illustration of a side view of an exemplary blade 14 showing a base 50, electrical heaters 52A, 52B, adhesive layers 54, and desiccant layers 56. The base 50 may be, for example, a printed circuit board (PCB), such as an FR4 PCB, a fiberglass board, or another temperature resistant substrate. In an embodiment, a heater, such as heater 52A, is on the surface of the base 50. In another embodiment, a heater, such as heater 52B, is embedded within the base 50. Preferably, the heaters 52A, 52B are on both sides of the base 50, regardless of whether they are on the surface of the base 50 or embedded within the base 50. Also, there may be multiple heaters 52 on a single blade 14 so as to provide for a higher temperature, a more even temperature distribution across the blade 14, and/or to control the temperature gradient from one side or end of the blade to another. In an embodiment, a heater 52 is an etched copper trace. In another embodiment, a heater 52 is a nichrome wire. In another embodiment, a heater 52 is an etched nichrome trace. In another embodiment, a heater 52 is a stainless steel wire. In another embodiment, a heater 52 is an etched stainless steel trace.

A layer of adhesive 54 is sprayed or otherwise applied to at least one side, and preferably to both sides, of the base 50. A layer of desiccant 56 is then sprayed or otherwise applied to at least one side, and preferably to both sides, of the base 50. The adhesive 54 binds the desiccant to the base 50 while leaving most of the desiccant 56 exposed to the air so that the desiccant 56 can readily adsorb (active phase 40) and release moisture (regeneration phase 42).

In an embodiment, a blade 14 coated with a thin amount of adhesive 54 and then the desiccant 56 is pressed onto the glue 54 until it dries. Excess and loosely attached desiccant 56 beads may then be removed with a brush.

In an embodiment, adhesive 54 is a high temperature electronics glue commonly referred to in the industry as a type 704 adhesive glue.

In an embodiment, the desiccant 56 is silica gel, a common type of desiccant. Other types of desiccant may be used in different environments, such as, but not limited to, molecular sieve, activated alumina, and composites of two or more different desiccants combined in some way to achieve a desirable property, such as but not limited to a combination of lithium chloride and silica gel.

In the active phase 40 fan 18 blows air across the blades 14 and the desiccant 56 adsorbs moisture from the air to provide the treated air 22. In the regeneration phase 42 electrical power is applied to the heaters 52 on a blade 14, which directly heats the blade 14, thereby heating the desiccant 56, and the heated desiccant 56 then releases the adsorbed moisture. Fan 24 blows air across the blades 14 in the regeneration phase, thereby removing the released moisture.

At least some of, and preferably but not necessarily all, the fan blades are coated with a desiccant. Also, at least some of, and preferably but not necessarily all, the blades 14 are selectively, directly heated by applying electrical current to the heaters 52.

Figure 4:
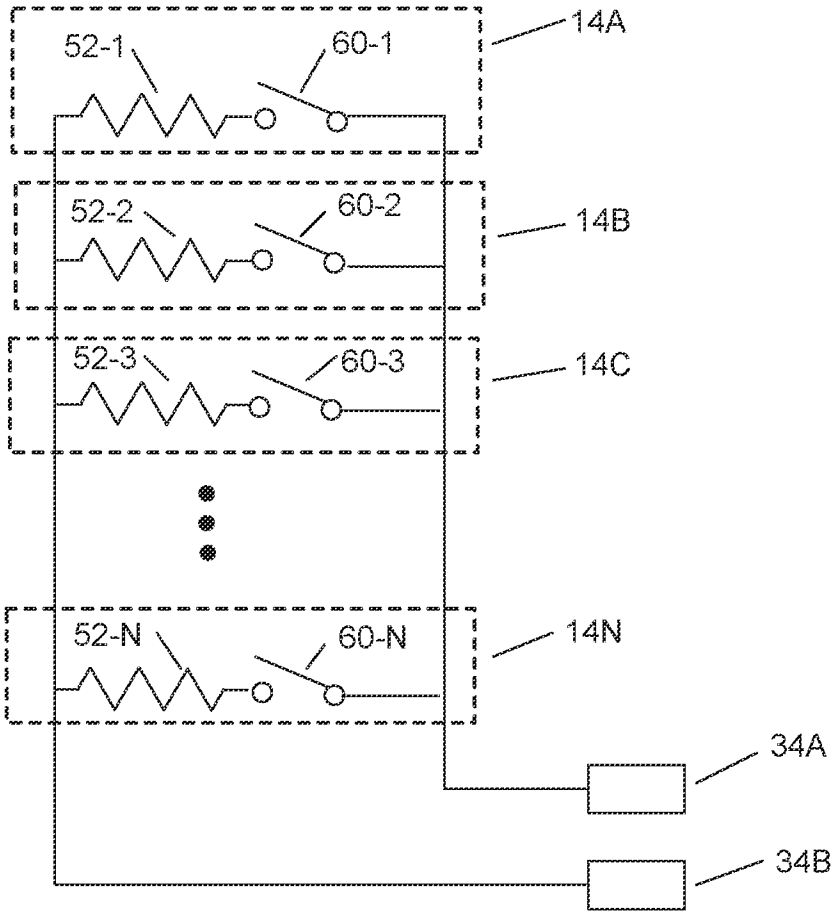
FIG. 4 is a diagram of an exemplary electrical circuit.

FIG. 4 is a diagram of an exemplary electrical circuit associated with blades 14. A blade 14, such as blade 14A, has a heater 52-1 and a corresponding series-connected switch 60-1. In an embodiment, the switch 60-1 is a magnetically-operated switch. Other types of switches may be used, if desired. One end of the heater 52-1 is connected to one of the slip rings 34, such as slip ring 34B; and one end of the switch 60-1 is connected to the other one of the slip rings 34, such as slip ring 34A. In an embodiment, the switch 60 is selected to be operable under the temperature, current, and voltage being applied, and may be, for example, in the middle of the heating element. A switch 60 is open when the corresponding blade 14 is in the active phase 40, and the switch 60 is closed, and electrical power is applied to the heater 52, when the corresponding blade 14 is in the regeneration phase 42.

Figure 5:
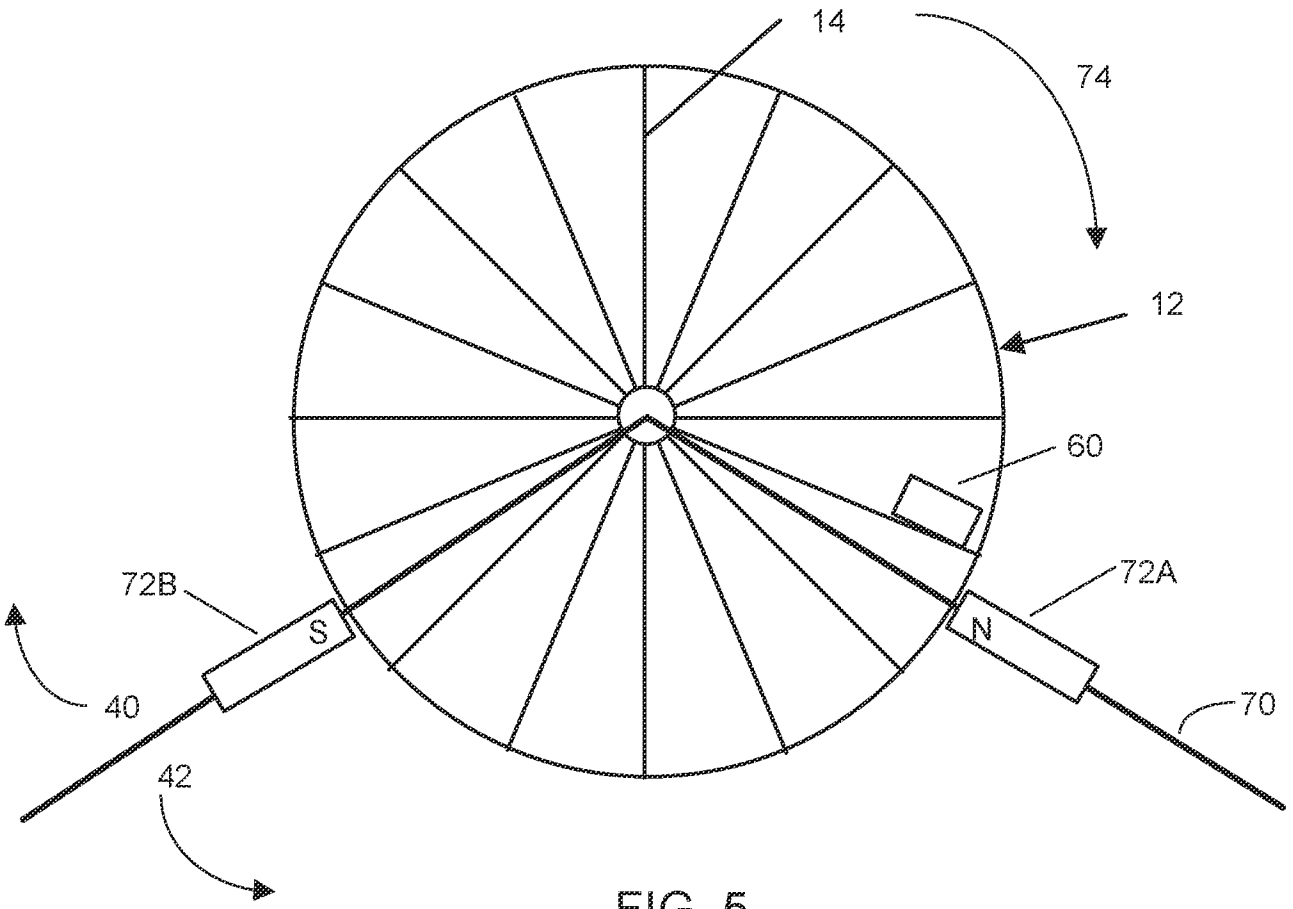
FIG. 5 is a diagram showing positions of exemplary magnets for controlling switches.

FIG. 5 is a diagram showing positions of exemplary magnets 72A, 72B for controlling the switches 60, and a line 70 showing a division between the active phase 40 and the regeneration phase 42. Assume that wheel 12 is rotating in direction 74. As the switch 60 passes under the influence of magnet 72A, switch 60 will close, thereby allowing electrical power to be applied to the heater(s) 52 of that particular blade 14 for the regeneration phase. As the wheel 12 continues to rotate, the switch 60 will pass under the influence of magnet 72B, which has the opposite magnetic polarity of magnet 72A, and the switch 60 will open, thereby discontinuing electrical power to the heater(s) 52 of that particular blade 14 for the active phase. The magnetic pole annotations N, S on the magnets 72A, 72B are for purpose of illustration, and opposite polarities could be used, depending upon the configuration of the particular switch 60 used.

In an embodiment, a switch 60 has a preferred or base position, such as closed, and opens when in the presence of a magnetic field, so that only a single magnet 72A or 72B is used. In that embodiment the single magnet 72A or 72B, rather than being a point magnet, would be an area or extended magnet so that its field is effective through the desired angle of activation.

Although magnetic switches 60 are described, the switches 60 can be any type of switch which can be controlled to selectively apply power to the heater(s) 52 at the appropriate time. For example, optical switches could be used.

In another embodiment, switching of the electrical power is controlled by a switch that is responsive to its orientation, for example, the switch being more upwardly or more downwardly (by gravity). In another embodiment, switching is controlled by a microcontroller located within the wheel, the microcontroller being responsive to gravity, a magnet, a mechanical contact, or other means. The microcontroller may be powered by the electrical power delivered via the slip rings 34, or another desired means of providing electrical power.

If desired, the magnet 72B may be positioned to cause a switch to open just before a blade 14 enters the active phase so as to allow the desiccant 56 to cool before it enters the active phase.

In an embodiment, the active phase is approximately 270 degrees of rotation, and the regeneration phase is approximately 90 degrees of rotation. As mentioned, the heating may be discontinued prior to the end of the regeneration phase 42 so as to allow the desiccant 52 time to cool before entering the active phase 40.

In an embodiment, the wheel 12 has a diameter of 400 mm and a width of 500 mm. In an embodiment, the wheel 12 has 64 blades.

In an embodiment, the motor 30 rotates the wheel 12 at a speed of one rotation per hour. Faster or slower rotation speeds may be preferable depending upon, for example, the type of desiccant 56 used, how quickly the desiccant 56 has reached a desired upper adsorption level, which may, if desired, be full adsorption, and how quickly the desiccant 56 can be regenerated—i.e., dried to a desired lower adsorption level.

Although direction 20 and direction 26 are shown as being in opposite directions, they may, if desired, be in the same direction. In an embodiment, there may be some intentional crossover (cross flow) of air flow between the active phase 40 and the regeneration phase 42.

Although the wheel 12 is shown as being driven via an axle 32, the wheel 12 may be driven by other means such as, for example, an external belt or an external gear system.

In one embodiment, the air is cooled by a sensible cooling system (not shown) before being applied to the desiccant dehumidifier system 10. In another embodiment, the treated air from the desiccant dehumidifier system 10 is applied to a subsequent sensible cooling system (not shown).

In an embodiment, a wheel 12 has a plurality of blades 14, at least some of the blades are covered by a desiccant 56 to adsorb moisture from air flowing across the blades 14 in an active phase, at least some of the blades 14 being selectively heated by one or more internal heaters 52 to dry the desiccant 56 during a regeneration phase.

The space between blades 14 increases as one moves radially from the axle to the periphery of the wheel. Therefore, although all blades 14 are shown as being the same length, in an embodiment there may be one or more blades of different lengths, extending from an outer periphery of the blades 14 toward the axle. This increases the number of blades and the surface area of the desiccant that is available to dry the air. Also, although generally flat blades are shown, blades having other shapes may be used. For example, a blade may have a corrugated or semi-corrugated surface so as to increase the surface area of the desiccant and/or to provide for turbulent airflow so as to make better contact between the air and the desiccant.

Figure 6A:
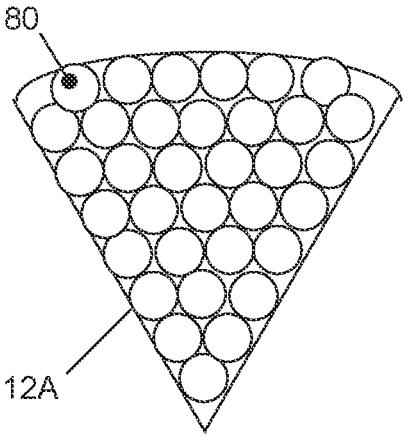
FIG. 6A illustrates a plurality of cylinders.
Figure 6B:
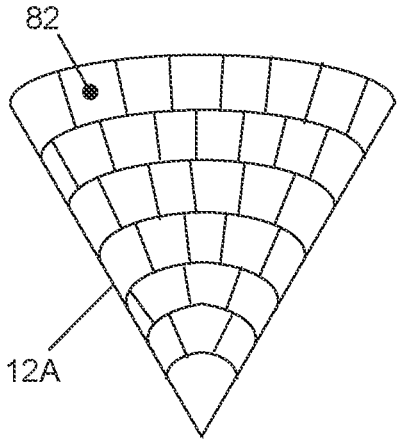
FIG. 6B illustrates a plurality of boxes.
Figure 6C:
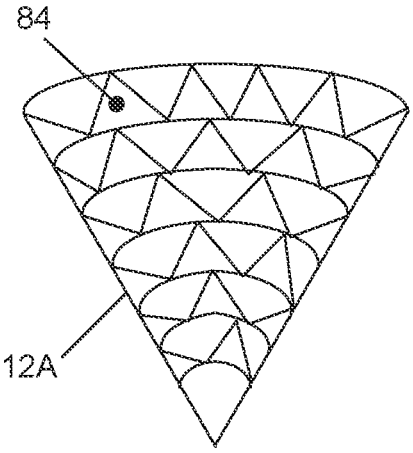
FIGS. 6C and 6D illustrate a plurality of teeth.
Figure 6D:
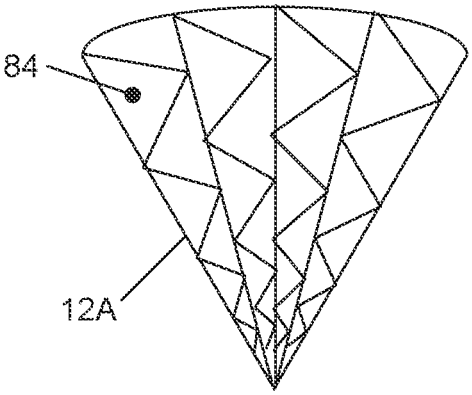
Figure 6E:
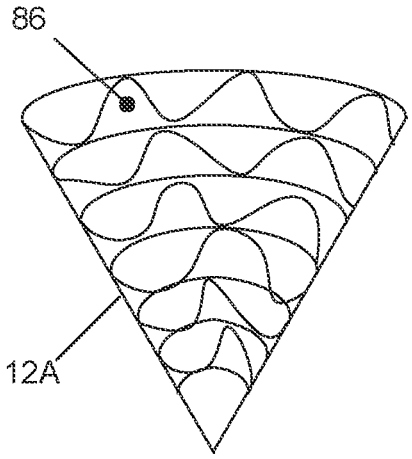
FIGS. 6E and 6F illustrate internal corrugations.
Figure 6F:
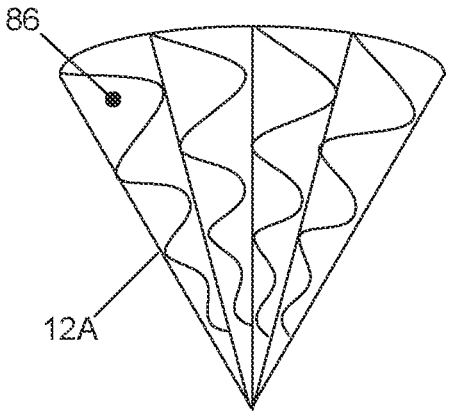

In an embodiment, rather than blades 14, the wheel 12 comprises a different type of internal structure. For example, FIGS. 6A-6F illustrate a plurality of different internal structures in a representative portion 12A of a wheel, looking into the wheel 12 from an axial viewpoint. FIG. 6A illustrates a plurality of cylinders 80. FIG. 6B illustrates a plurality of boxes 82. FIGS. 6C and 6D illustrate a plurality of teeth 84. FIGS. 6E and 6F illustrate internal corrugations 86.

The number of angular sections in the representation portion 12A, the number of cylinders 80, the number of boxes 82, the number of teeth 84, and the number of internal corrugations 86 shown are for clarity of drawing and are not intended to indicate an actual number of, or the precise shape of, these internal structures.

Although the elements of the internal structure (cylinders 80, boxes 82, teeth 84, and corrugations 86) are illustrated as being of a uniform size, this is for convenience of drawing. If desired, the elements of the internal structure could have different sizes so as to provide a plurality of different cross-sections for air flow.

Also, if desired, different internal structures could be used at different radial positions, such as cylinders 82 near the axle, and boxes 84 near the periphery.

Some of these internal structures may already be in use in conventional desiccant structures where heated air is drawn or forced through the structure to regenerate the desiccant.

There are various advantages/disadvantages to these different internal structures and tradeoff decisions are often between moisture uptake capability and air pressure drop through the structure.

Heating elements 52 are associated with the various elements of the different internal structures. In an embodiment, a different heating element 52 is associated with each internal structure (cylinder 80, box 82, tooth 84, corrugation 86). In another embodiment, each heating element 52 is associated with a group of internal structures. A heating element 52 may be, for example, a conductive element or trace that travels or spirals from one end of an internal structure to the other end of the internal structure. For example, a conductive trace could be pre-etched on one or more flat strips and rolled up diagonally in manner similar to that in which paper straws are made. Also, a heating element 52 may be on the inside surface of, internal to, or on the outside surface of an internal structure.

In an embodiment, the desiccant 56 is applied to the inside surface of an internal structure. The internal structures of FIGS. 6B-6F may be constructed so as not to have an outside surface. If the heating element 52 is on the inside surface of the internal structure, then the desiccant 56 is also applied over the heating element 52.

In an embodiment, a heating element 52 has a positive temperature coefficient (PTC). This type of heating element 52 has a self-limiting characteristic, which provides a degree of inherent temperature control and safety.

Figure 7:
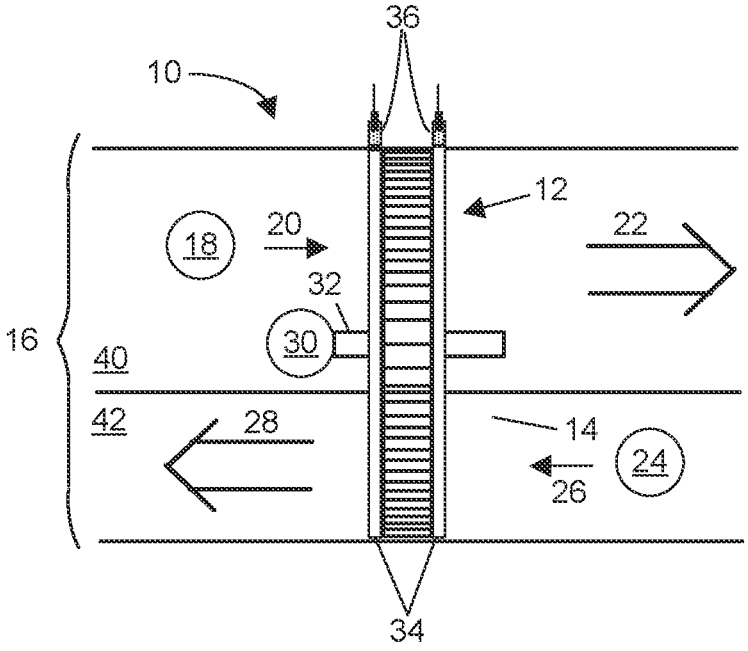
FIG. 7 illustrates another embodiment, in which the slip rings are mounted on the periphery of the wheel.

FIG. 7 illustrates another embodiment, in which the slip rings 34 are mounted on the periphery of the wheel 12. The sliding contacts 36 are also shown. Although the slip rings 34 are shown as being on the outer edges of the wheel 12, they may be located inward from the outer edges if desired.

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations may be well known in the art, and because they do not facilitate a better understanding of the present disclosure, a discussion of such elements and operations is not provided herein. The present disclosure is deemed to inherently include all such elements, variations, and modifications to the described aspects that would be known to those of ordinary skill in the art, particularly in view of reading the present disclosure.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc., may be used herein to describe various elements, components, regions, layers and/or sections, these elements, components, regions, layers and/or sections should not be limited by these terms. These terms may be only used to distinguish one element, component, region, layer or section from another element, component, region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the exemplary embodiments.

Unless otherwise defined, all terms (including technical and scientific terms) used herein have the same meaning as commonly understood by one of ordinary skill in the art to which this subject matter belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. For brevity and/or clarity, well-known functions or constructions may not be described in detail herein.

The terms "for example" and "such as" mean "by way of example and not of limitation." The subject matter described herein is provided by way of illustration for the purposes of teaching, suggesting, and describing, and not limiting or restricting. Combinations and alternatives to the illustrated embodiments are contemplated, described herein, and set forth in the claims.

For convenience of discussion herein, when there is more than one of a component, that component may be referred to herein either collectively or singularly by the singular reference numeral unless expressly stated otherwise or the context clearly indicates otherwise. For example, components N (plural) or component N (singular) may be used unless a specific component is intended. Also, the singular forms "a," "an," and "the" are intended to include the plural forms as well, unless expressly stated otherwise or the context indicates otherwise.

The terms "includes," "has," "having," or "exhibits," or variations in form thereof are intended to be inclusive in a manner similar to the term "comprises" as that term is interpreted when employed as a transitional word in a claim.

It will be understood that when a component is referred to as being "connected" or "coupled" to another component, it can be directly connected or coupled or coupled by one or more intervening components unless expressly stated otherwise or the context clearly indicates otherwise.

The term "and/or" includes any and all combinations of one or more of the associated listed items. As used herein, phrases such as "between X and Y" and "between about X and Y" should be interpreted to include X and Y unless expressly stated otherwise or the context clearly indicates otherwise.

Terms such as "about", "approximately", "around", and "substantially" are relative terms and indicate that, although two values may not be identical, their difference is such that the apparatus or method still provides the indicated or desired result, or that the operation of a device or method is not adversely affected to the point where it cannot perform its intended purpose. As an example, and not as a limitation, if a height of "approximately X inches" is recited, a lower or higher height is still "approximately X inches" if the desired function can still be performed or the desired result can still be achieved.

While the terms vertical, horizontal, upper, lower, bottom, top, and the like may be used herein, it is to be understood that these terms are used for ease in referencing the drawing and, unless otherwise indicated or required by context, does not denote a required orientation.

The different advantages and benefits disclosed and/or provided by the embodiment(s) disclosed herein may be used individually or in combination with one, some or possibly even all of the other benefits. Furthermore, not every embodiment, nor every component of an embodiment, is necessarily required to obtain, or necessarily required to provide, one or more of the advantages and benefits of the embodiment.

Conditional language, such as, among others, "can", "could", "might", or "may", unless specifically stated otherwise, or otherwise understood within the context as used, is generally intended to convey that certain embodiments preferably or optionally include certain features, elements and/or steps, while some other embodiments optionally do not include those certain features, elements and/or steps. Thus, such conditional language indicates, in general, that those features, elements and/or step may not be required for every embodiment.

The subject matter described herein is provided by way of illustration only and should not be construed as limiting the nature and scope of the claims herein. While different embodiments have been provided above, it is not possible to describe every conceivable combination of components or methodologies for implementing the disclosed subject matter, and one of ordinary skill in the art may recognize that further combinations and permutations that are possible. Furthermore, the nature and scope of the claims is not necessarily limited to embodiments that solve any or all disadvantages which may have been noted in any part of this disclosure. Various modifications and changes may be made to the subject matter described herein without following, or departing from the spirit and scope of, the exemplary embodiments and applications illustrated and described herein. Although the subject matter presented herein has been described in language specific to components used therein, it is to be understood that the scope of the claims is not necessarily limited to the specific components or characteristics thereof described herein; rather, the specific components and characteristics thereof are disclosed as example forms of implementing the disclosed subject matter. Accordingly, the disclosed subject matter is intended to embrace all alterations, modifications, and variations, that fall within the scope and spirit of any claims that may be written therefor.

The invention claimed is:

1. A desiccant configuration, comprising:

a plurality of similar structures;

a plurality of electrical heaters, an electrical heater of the plurality of electrical heaters being associated with a corresponding similar structure of the plurality of similar structures;

a plurality of switches, a switch of the plurality of switches selectively applying operating power to a corresponding electrical heater of the plurality of electrical heaters;

slip rings, the switches of the plurality of switches being positioned away from the slip rings, distinct from the slip rings, and separate from the slip rings, wherein operating power is selectively provided to the plurality of electrical heaters through the slip rings and the plurality of switches; and a desiccant, the desiccant coating at least a portion of each similar structure of the plurality of similar structures.

2. The desiccant configuration of claim 1, further comprising an adhesive to secure the desiccant to at least one of an electrical heater of the plurality of electrical heaters or to a similar structure of the plurality of similar structures.

3. The desiccant configuration of claim 1, wherein the similar structures are selected from the group comprising: a cylinder, a box, and a corrugation.

4. The desiccant configuration of claim 1, wherein a switch of the plurality of switches is a magnetically-operated switch.

5. The desiccant configuration of claim 1, wherein the desiccant configuration is a wheel having an axle, and wherein the slip rings are mounted on the axle.

6. The desiccant configuration of claim 1, wherein the desiccant configuration is a wheel having a periphery, and wherein the slip rings are mounted on the periphery.

7. The desiccant configuration of claim 1, wherein the electrical heater associated with the corresponding similar structure is on the corresponding similar structure.

8. The desiccant configuration of claim 1, wherein the electrical heater associated with the corresponding similar structure is embedded within the corresponding similar structure.

9. An air treatment apparatus, comprising:

a desiccant wheel, the desiccant wheel comprising:

a plurality of similar structures;

a plurality of electrical heaters, an electrical heater of the plurality of electrical heaters being associated with a corresponding similar structure of the plurality of similar structures;

a plurality of switches, a switch of the plurality of switches selectively applying operating power to a corresponding electrical heater of the plurality of electrical heaters; and a desiccant, the desiccant coating at least a portion of each similar structure of the plurality of similar structures, a plurality of activators controlling the plurality of switches;

slip rings, the switches of the plurality of switches being positioned away from the slip rings, distinct from the slip rings, and separate from the slip rings, wherein operating power is selectively provided to the plurality of electrical heaters through the slip rings and the plurality of switches a motor to rotate the desiccant wheel;

a shroud which separates the desiccant wheel into an active area and a regeneration area;

wherein an activator of the plurality of activators causes the switch of the plurality of switches to apply operating power to the corresponding electrical heater for the corresponding similar structure which is in the regeneration area; and at least one fan which drives air through the desiccant wheel.

10. The air treatment apparatus of claim 9, further comprising an adhesive to secure the desiccant to at least one of an electrical heater of the plurality of electrical heaters or to a similar structure of the plurality of similar structures.

11. The air treatment apparatus of claim 9, wherein the similar internal structures are selected from the group comprising: a cylinder, a box, and a corrugation.

12. The air treatment apparatus of claim 9, wherein a switch of the plurality of switches is a magnetically-operated switch.

13. The air treatment apparatus of claim 9, wherein the desiccant wheel has an axle, and the slip rings are mounted on the axle.

14. The air treatment apparatus of claim 9, wherein the desiccant wheel has a periphery, and the slip rings are mounted on the periphery.

15. The air treatment apparatus of claim 9, wherein the at least one fan drives air through the active area of the desiccant wheel, and a second fan drives air through the regeneration area of the desiccant wheel.

16. The air treatment apparatus of claim 9, wherein a similar structure of the plurality of similar structures has a first side and a second side, and wherein the first side has a first electrical heater of the plurality of electrical heaters and the second side has a second electrical heater of the plurality of electrical heaters.

17. An air treatment apparatus, comprising:

a desiccant wheel, the desiccant wheel comprising:

a plurality of similar structures arranged about an axis of rotation;

a desiccant, the desiccant coating at least a portion of each similar structure of the plurality of similar structures;

a plurality of electrical heaters, an electrical heater of the plurality of electrical heaters being associated with a corresponding similar structure of the plurality of similar structures;

an adhesive to secure the desiccant to at least one of an electrical heater of the plurality of electrical heaters or to a similar structure of the plurality of similar internal structures;

a plurality of magnetic switches, a magnetic switch of the plurality of magnetic switches selectively applying operating power to a corresponding electrical heater of the plurality of electrical heaters; and slip rings, the magnetic switches of the plurality of magnetic switches being positioned away from the slip rings, distinct from the slip rings, and separate from the slip rings, wherein operating power is selectively provided to the plurality of electrical heaters through the slip rings and the plurality of magnetic switches;

a motor to rotate the desiccant wheel about the axis of rotation;

a shroud which separates the desiccant wheel into an active area and a regeneration area;

a first magnet to apply a first magnetic field polarity;

a second magnet to apply a second magnetic field polarity;

wherein a magnetic switch of the plurality of magnetic switches applies operating power to the corresponding electrical heater of the plurality of electrical heaters when the first magnetic field polarity is applied, and does not apply operating power to the corresponding electrical heater when the second magnetic field polarity is applied;

a first fan which drives air through the active area of the desiccant wheel; and a second fan which drives air through the regeneration area of the desiccant wheel.

18. The air treatment apparatus of claim 17, wherein the similar structures are selected from the group comprising: a cylinder, a box, and a corrugation.

19. The air treatment apparatus of claim 17, wherein the desiccant wheel has an axle, and wherein the slip rings are mounted on the axle.

20. The air treatment apparatus of claim 17, wherein the desiccant wheel has a periphery, and wherein the slip rings are mounted on the periphery.

* * * * *